US006120982A

United States Patent [19]

Parton et al.

[11] Patent Number: 6,120,982

[45] Date of Patent: Sep. 19, 2000

[54] RED SENSITIZING DYE COMBINATIONS FOR HIGH CHLORIDE EMULSIONS

[75] Inventors: Richard Lee Parton, Webster; Paul Timothy Hahm, Hilton, both of N.Y.

[73] Assignee: Eastman Kodak Company, Rochester, N.Y.

[21] Appl. No.: 08/629,301

[22] Filed: Apr. 8, 1996

[51] Int. Cl.[7] ..... G03C 1/29; G03C 1/20

[52] U.S. Cl. ..... 430/574; 430/572; 430/584; 430/613; 430/933; 430/963

[58] Field of Search ..... 430/574, 584, 430/933, 576, 963, 572, 611, 613, 604

[56] References Cited

U.S. PATENT DOCUMENTS

| | | | |
|---|---|---|---|
| 3,617,293 | 11/1971 | Shiba et al. . | |
| 4,442,201 | 4/1984 | Takada et al. | 430/569 |
| 4,820,624 | 4/1989 | Hasebe et al. | 430/567 |
| 4,920,042 | 4/1990 | Waki | 430/380 |
| 4,939,080 | 7/1990 | Hioki et al. | 470/576 |
| 5,112,731 | 5/1992 | Miyasaka | 430/567 |
| 5,126,237 | 6/1992 | Okumura et al. | 430/577 |
| 5,154,995 | 10/1992 | Kawai et al. | 430/22 |
| 5,175,080 | 12/1992 | Hioki et al. | 430/584 |
| 5,223,385 | 6/1993 | Hasebe | 430/546 |
| 5,246,828 | 9/1993 | Okuyama et al. | 430/576 |
| 5,252,454 | 10/1993 | Suzumoto et al. | 430/584 |
| 5,260,183 | 11/1993 | Ishiguro et al. | 430/567 |
| 5,290,675 | 3/1994 | Hioki et al. | 430/576 |
| 5,296,343 | 3/1994 | Hioki et al. | 430/508 |
| 5,338,657 | 8/1994 | Kato et al. | 430/584 |
| 5,518,876 | 5/1996 | Parton et al. | 430/584 |

FOREIGN PATENT DOCUMENTS

| | | |
|---|---|---|
| 0 271 260 | 6/1988 | European Pat. Off. . |
| 0 286 331 | 10/1988 | European Pat. Off. . |
| 0 563 860 | 10/1993 | European Pat. Off. . |
| 0 605 917 | 7/1994 | European Pat. Off. . |
| 4002016 | 8/1990 | Germany . |
| 60-225147A | 11/1985 | Japan . |
| 61-093448A | 5/1986 | Japan . |
| 62-131250A | 6/1987 | Japan . |
| 62-253141A | 11/1987 | Japan . |
| 63-259649A | 10/1988 | Japan . |
| 01124843A | 5/1989 | Japan . |
| 1124844A | 5/1989 | Japan . |
| 01189649A | 7/1989 | Japan . |
| 02140736A | 5/1990 | Japan . |
| 02212832A | 8/1990 | Japan . |
| 03080251A | 4/1991 | Japan . |
| 03181939A | 8/1991 | Japan . |
| 4-73740 | 3/1992 | Japan . |
| 04322244A | 11/1992 | Japan . |
| 2216279 | 10/1989 | United Kingdom . |

OTHER PUBLICATIONS

Lange's Hanbook of Chemistry, Fourth Edition, McGraw–Hill, Inc, John A. Dean, pp. 9.1–9.7, 1992.

Berry, Chester R., *Changes of Silver Halide Energy Levels with Temperature and Halide Composition*, vol. 19, No. 2, (Mar./Apr. 1975), pp. 93–95.

Vanassche, W., The Effect of Chemical Sensitization and Halogen Composition of the Emulsion on Spectral Sensitization, The Journal of Photographic Science, vol. 21, (1973), pp. 180–186.

Gillman, P.B., Use of Spectral Sensitizing Dyes to Estimate Effective Energy Levels of Silver Halide, Photographic Science and Engineering, vol, 18 No. 5 (Sep. /Oct. 1974), pp. 475–485.

*Primary Examiner*—Thorl Chea
*Attorney, Agent, or Firm*—Edith A. Rice

[57] ABSTRACT

A silver halide photographic material comprises a red sensitive layer which contains a high chloride emulsion sensitized with at least two red sensitizing dyes. By adjusting the relative amounts of the two dyes the heat sensitivity of the red layer can be adjusted to match that of the blue sensitive and green sensitive layers to maintain color balance despite thermal fluctuations.

18 Claims, No Drawings

RED SENSITIZING DYE COMBINATIONS FOR HIGH CHLORIDE EMULSIONS

FIELD OF THE INVENTION

This invention relates to a photographic material having a silver halide emulsion which is red sensitized with at least two red sensitizing dyes.

BACKGROUND OF THE INVENTION

There is a great emphasis on high productivity in the photosensitive materials market. Photofinishers that use photosensitive paper to produce color prints desire short processing times in order to increase output. One way to obtain rapid processing is to accelerate the development time by increasing the chloride content of the emulsions; the higher the chloride content the higher the development rate. However, it is also known that the higher the chloride content is, the harder it is to obtain high, invariant photosensitivity. Emulsions that are primarily silver chloride are more difficult to spectrally sensitize than emulsions used previously such as silver bromide or chlorobromide emulsions because the conduction band of silver chloride is higher than that of silver bromide (C. R. Berry, Photo. Sci. & Eng. 19, 93, (1975)).

The problem with sensitizing efficiency is especially true in the red-sensitive layer of many color print photosensitive materials and is related to the red sensitizers reduction potential. Correlations between dye reduction potentials and sensitizing efficiency on high silver chloride emulsions are discussed by W. Vanassche, J. Photo. Sci., 21, 180 (1973) and P. B. Gilman, Jr., Photo. Sci. & Eng. 18, 475 (1974). Another common problem with the red sensitive layer of color print paper which contains an emulsion that is primarily silver chloride, is an undesirable sensitivity to temperature. An increase in temperature of the paper during exposure results in an increase in red speed of the red sensitive layer making it difficult for the photofinisher to adjust his printing conditions. This results in a loss in operating efficiency.

An example of heat sensitivity is illustrated below. Material C has no propensity for heat sensitivity while Material A and B have equal propensity but in opposite directions. Color photographic materials typically respond to three regions of the spectrum, red, green and blue with different emulsions and, as an example for color positive paper such as EKTACOLOR Paper, will produce cyan, magenta and yellow dye images when processed in Process RA-4. If the paper temperature changes during the day as it is printed such as due to changing ambient conditions or warming up in the printing environment, the prints can change in density causing a variability in the image produced. With color products a mis-match in the heat sensitivity response of the three layers results in a color shift in the prints. So, while it would be useful to have low heat sensitivity to preserve color consistency in printing, it is more important with color products to have a consistent heat sensitivity shift in all three layers to avoid a shift in the more critical area of color balance. Almost all of the materials used to prepare silver halide emulsions can under some conditions affect the heat sensitivity of the resulting photographic materials. It is therefore desirable to have the ability to adjust the heat sensitivity of a particular emulsion to the appropriate level to match the other two layers.

| | Speed (Log E) of Materials at 22° C. | Speed (Log E) of Materials at 40° C. | Heat Sensitivity (Delta Log E) |
|---|---|---|---|
| Material A | 1.90 | 2.00 | +.10 |
| Material B | 2.00 | 1.90 | −.10 |
| Material C | 1.90 | 1.90 | 0.00 |

European published patent application EP 605,917 A2 describes red dyes that give high speed and reduced heat sensitivity when used on high chloride emulsions. However, by the use of these red sensitizers, the heat sensitivity of the cyan layer is so low that it no longer matches that of the magenta and yellow records. This causes an undesirable color balance shift during thermal changes. It is therefore desirable to provide a means of adjusting the heat sensitivity in the cyan layer so as to match that of the magenta and yellow layers. It is toward this end that this invention is directed.

PROBLEM TO BE SOLVED BY THE INVENTION

The prior art teaches the use of red dyes that give reduced heat sensitivity. But there is no teaching on how to use these dyes so that the heat sensitivity of the red layer matches that of the magenta and yellow records and thus to avoid heat induced changes in color balance.

SUMMARY OF THE INVENTION

One aspect of this invention comprises a silver halide photographic material comprising a red sensitive silver halide emulsion layer, the silver halide of which is at least 90 mole percent silver chloride, and which emulsion has a dye of Class A and a dye of Class B:

where,

Class A dyes have structure I and substituents $W_1$–$W_8$ are chosen such that J is ≧0.0, where J is defined as the sum of the Hammett $\sigma_p$ values of $W_{1-8}$, or, alternatively, Class A dyes can also have the structure II provided substituents $W_1$–$W_8$ are chosen such that J is ≧0.24;

Class B dyes have structure II and substituents $W_1$–$W_8$ are chosen independently such that J is ≦0.10, or, alternatively, Class B dyes can also have structure I provided substituents $W_1$–$W_8$ are chosen such that J is ≦−0.14

(I)

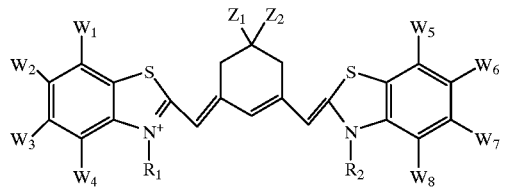

X

-continued (II)

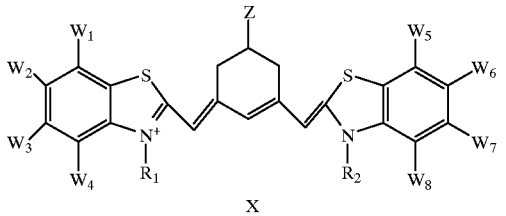

X where, $R_1$ and $R_2$ each independently represent an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group.

The emulsion preferably also contains an anti-aggregating agent. Preferably the anti-aggregating agent is compound III which has the structure:

(III)

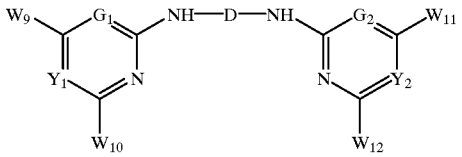

wherein:

D is a divalent aromatic moiety; $W_9$–$W_{12}$ each independently represents a hydroxy, a halogen atom, an amino, alkylamino, arylamino, cycloalkylamino, a heterocyclic, heterocyclicamino, arylalkylamino, alkoxy, aryloxy, alkylthio, heterocyclicthio, mercapto, alkylthio, arylthio or aryl group, any of which may be substituted or unsubstituted, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

ADVANTAGEOUS EFFECT OF THE INVENTION

The present invention provides photographic materials with a high silver chloride layer having high red sensitivity while at the same time having relatively low thermal sensitivity. A method is described to adjust the heat sensitivity of the cyan layer so as to match that of the magenta and yellow layers to maintain color balance despite thermal fluctuations.

DETAILED DESCRIPTION OF EMBODIMENTS OF THE INVENTION

In the present application, by reference to "under", "above", "below", "upper", "lower" or the like terms in relation to layer structure of a photographic element, is meant in this application, the relative position in relation to light to when the element is exposed in a normal manner. "Above" or "upper" would mean closer to the light source when the element is exposed normally, while "below" or "slower" would mean further from the light source. Since a typical photographic element has the various layers coated on a support, "above" or "upper" would mean further from the support, while "below" or "under" would mean closer to the support.

When reference in this application is made to a substituent "group", this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

In the above formulae (I) and (II), $W_1$–$W_8$ each independently represent an alkyl, acyl, acyloxy, alkoxycarbonyl, carbonyl, carbamoyl, sulfamoyl, carboxyl, cyano, hydroxy, amino, acylamino, alkoxy, alkylthio, alkylsulfonyl, sulfonic acid, aryl, or aryloxy group, any of which may be substituted or unsubstituted, or a hydrogen or halogen atom, and provided further that adjacent ones of $W_1$–$W_8$ can bonded to each other via their carbon atoms to form a condensed ring. Class A dyes have structure I and substituents $W_1$–$W_8$ are chosen such that J is $\geqq 0.0$, or, alternatively, Class A dyes can also have the structure II provided substituents $W_1$–$W_8$ are chosen such that J is $\geqq 0.24$ and Class B dyes have structure II and substituents $W_1$–$W_8$ are chosen such that J is $\leqq 0.10$, or, alternatively, Class B dyes can also have structure I provided substituents $W_1$–$W_8$ are chosen such that J is $\leqq -0.14$. Hammett $\sigma_p$ values are discussed in *Advanced Organic Chemistry* 3rd Ed., J. March, (John Wiley Sons, NY; 1985). Note that the "p" subscript refers to the fact that the σ values are measured with the substituents in the para position.

Z is a hydrogen or halogen atom or an alkyl group or substituted alkyl group, for example a 1 to 8 carbon atom alkyl group or substituted alkyl group. Preferably Z is a relatively "flat" substituent, such as a hydrogen, halogen or a methyl (substituted or unsubstituted). More particularly Z may be a substituted or unsubstituted methyl or a hydrogen.

$Z_1$ and $Z_2$ are independently be a 1 to 8 carbon alkyl group (for example, methyl, ethyl, propyl, butyl or the like).

Preferably at least one of $R_1$ or $R_2$, or both, are alkyl of 1–8 carbon atoms, either of which alkyl may be substituted or unsubstituted. Examples of preferred substituents include acid or acid salt groups (for example, sulfo or carboxy groups). Thus, either or both $R_1$ or $R_2$ could be, for example, 2-sulfobutyl, 3-sulfopropyl and the like, or sulfoethyl.

Examples of Class A and B dyes used in materials of the present invention are listed below in Table I but the present invention is not limited to the use of these dyes.

TABLE I

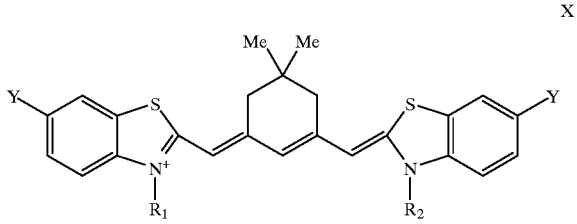

| Dye | Y | R1 | R2 | X |
|---|---|---|---|---|
| A-1 | H | 3Sp | Et | — |
| A-2 | H | Et | Et | pts⁻ |
| B-3 | Me | Et | Et | pts⁻ |

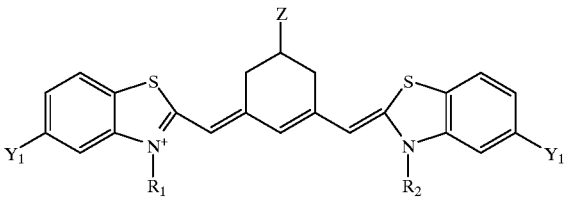

| Dye | Z | Y1 | R1 | R2 | X |
|---|---|---|---|---|---|
| A-3 | H | Cl | Et | Et | pts⁻ |
| B-1 | H | H | Et | Et | pts⁻ |
| B-2 | H | Ph | Et | Et | pts⁻ |

In a preferred embodiment of the invention a silver halide photographic material comprises a red sensitive silver halide emulsion layer, the silver halide of which is at least 90 mole percent silver chloride, and which emulsion has a dye of formula (Ia) used in combinations with a dye for formula (IIa):

(Ia)

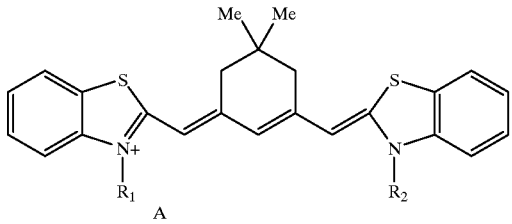

A

-continued (IIa)

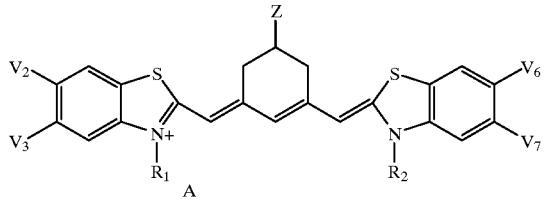

A where:

$R_1$ and $R_2$ each independently represent an alkyl group or a substituted alkyl group;

$V_2$–$V_7$ are independently H or a 1 to 8 carbon alkyl;

Z is a hydrogen or methyl;

A is a counterion if needed to balance the charge.

In compound III, D is a divalent aromatic moiety, preferably selected from the group consisting of:

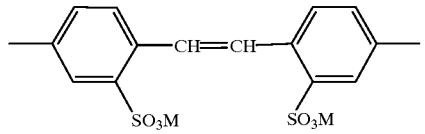

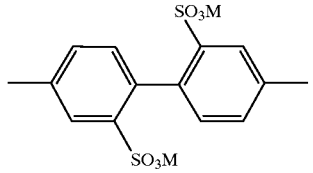

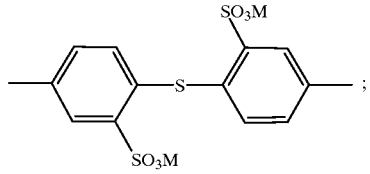

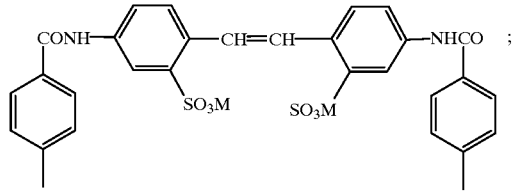

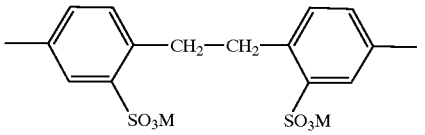

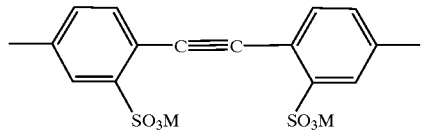

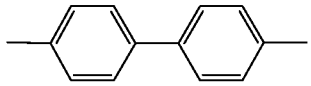

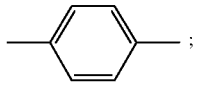

-continued

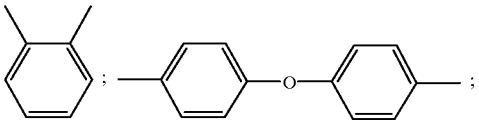

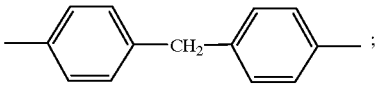

and

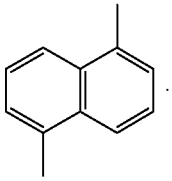

In the above, M is a hydrogen atom or a cation so as to increase water solubility, such as an alkali metal ion (Na, K, and the like) or an ammonium ion.

Some particular examples of compounds of Formula III above are listed below. Again, the invention is not limited to the use of those specific compounds:

III-1

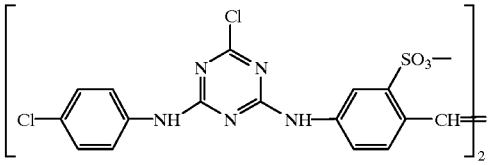

III-2

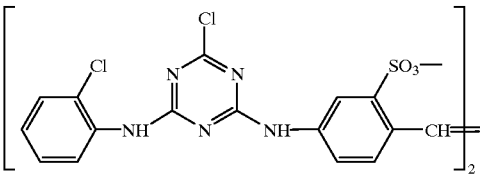

III-3

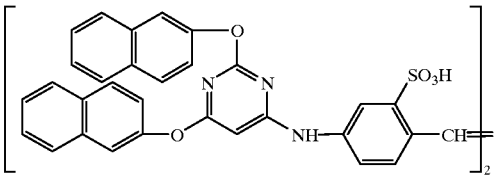

Dyes of Class A and B and compounds of formula III can be prepared according to techniques that are well-known in the art, such as described in Hamer, *Cyanine Dyes and Related Compounds,* 1964 (publisher John Wiley & Sons, New York, N.Y.) and James, *The Theory of the Photographic Process* 4th edition, 1977 (Eastman Kodak Company, Rochester, N.Y.). The amount of sensitizing dye that is useful in the invention may be from 0.001 to 4 millimoles, but is preferably in the range of 0.01 to 4.0 millimoles per mole of silver halide and more preferably from 0.02 to 0.25 millimoles per mole of silver halide. Optimum dye concentrations can be determined by methods known in the art. Formula III compounds can be typically coated at 1/50 to 50 times the dye concentration, or more preferably 1 to 10 times.

The silver halide used in the photographic materials of the present invention preferably contains at least about 90% silver chloride or more (for example, at least about 95%, 98%, 99% or 100% silver chloride). Some silver bromide may be present; in particular, the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % values are mole %.

The photographic materials of the present invention can use the combination of dyes of Class A and Class B and the Formula III compound with tabular grain emulsions such as disclosed by Wey U.S. Pat. No. 4,399,215; Kofron U.S. Pat. No. 4,434,226; Maskasky U.S. Pat. No. 4,400,463; and Maskasky U.S. Pat. No. 4,713,323; as well as disclosed in allowed US applications: Ser. No. 819,712 (filed Jan. 13, 1992), Ser. No. 820,168 (filed Jan. 13, 1992), Ser. No. 762,971 (filed Sep. 20, 1991), Ser. No. 763,013 (filed Jan. 13, 1992), and pending U.S. application Ser. No. 763,030 (filed Sep. 20, 1992). The grain size of the silver halide may have any distribution known to be useful in photographic compositions, and may be ether polydipersed or monodispersed.

The silver halide grains to be used in the invention may be prepared according to methods known in the art, such as those described in *Research Disclosure,* (Kenneth Mason Publications Ltd, Emsworth, England), September, 1994, Number 365, Item 36544 (hereinafter referred to as *Research Disclosure I*) and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. High chloride [1 0 0] tabular emulsions such as described in EP 534,395 can also be used.

The silver halide to be used in the invention may be advantageously subjected to chemical sensitization with compounds such as gold sensitizers (e.g., gold and sulfur) and others known in the art. Compounds and techniques useful for chemical sensitization of silver halide are known in the art and described in *Research Disclosure I* and the references cited therein.

The photographic materials of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), polyvinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as illustrated in *Research Disclosure,* June 1975, item 13452 and U.S. Pat. No. 3,772,031.

The silver halide may be sensitized by the combination of dyes of Class A and Class B preferably together with compounds of Formula III by methods known in the art, such as described in *Research Disclosure I.* The compounds may be added to an emulsion of the silver halide grains and a hydrophilic colloid at any time prior to (e.g., during or after chemical sensitization) or simultaneous with the coating of the emulsion on a photographic element. The resulting sensitized silver halide emulsion may be mixed with a dispersion of color image-forming coupler immediately before coating or in advance of coating (for example, 2 hours). Essentially any type of emulsion (e.g., negative-working emulsions such as surface-sensitive emulsions of unfogged internal latent image-forming emulsions, direct-positive emulsions such as surface fogged emulsions, or others described in, for example, *Research Disclosure I*) may be used. The above-described sensitizing dyes of Class A and Class B and compounds of Formula III can be used alone, or may be used in combination with other sensitizing dyes, e.g. to also provide the silver halide with sensitivity to wavelengths of light outside the red region or to supersensitize the silver halide.

Other addenda in the emulsion may include antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein. The emulsion may also include brighteners, such as stilbene brighteners.

The emulsion layer containing silver halide sensitized with as described above, can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers, antistatic agents, optical brighteners, light-absorbing or light-scattering pigments, and the like. The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic materials of the present invention can be black and white photographic elements but are preferably color photographic elements. A color photographic element generally contains three silver emulsion layers or sets of layers (each set of layers often consisting of emulsions of the same spectral sensitivity but different speed): a blue-sensitive layer having a yellow dye-forming color coupler associated therewith; a green-sensitive layer having a magenta dye-forming color coupler associated therewith; and a red-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I.*

Photographic elements of the present invention may also usefully include a magnetic recording layer as described in *Research Disclosure, Item* 34390, November 1992.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977.

PHOTOGRAPHIC EXAMPLE 1

A high chloride silver halide emulsion was precipitated by equimolar addition of silver nitrate and sodium chloride solutions into a well-stirred reactor containing gelatin peptizer and thioether ripener. The resultant emulsion contains cubic shaped grains of 0.38 $\mu$m in edgelength size. Portions of this emulsion were sensitized in the following manner. The emulsion at 40° C. was adjusted to a pH of 4.3 with nitric acid and a vAg of 129 mV with KCl and combined with compound III-2 ($22.4\times10^{-5}$ mol/mol Ag) followed by gold and sulfur sensitization. The temperature was increased to 60° C. and dye B-1 was added (various levels were used, see Table II), an anti-foggant was added (1-(3-acetamidophenyl)-5-mercaptotetrazole, $0.95\times10^{-3}$ mol/mol Ag), and then a fine grained AgBr emulsion (0.011 mol/mol Ag), the temperature was then decreased to 40° C. and the pH of the emulsion was adjusted to 5.6 using NaOH solution. The dye A-1 was added (various levels were used, see Table II).

The emulsions were coated on paper support at 0.18 g/m$^2$. A dispersion of a color coupler, 2-[2,4-bis(1,1-dimethylpropyl)phenoxy]-N-(3,5-dichloro-4-ethyl-2-hydroxyphenol)butanamide (0.42 g/m$^2$), was added to the dye/silver chloride emulsion immediately before coating. The final gel level was (1.66 g/m$^2$); the layer also had an undercoat at (3.23 g/m$^2$) of gelatin and an overcoat of (1.1 g/m$^2$) of gelatin. The hardener, bis(vinylsulfonylmethane), level was 1.75% of the gelatin weight.

The coatings were given a 0.1 second exposure, using a 0–3 step tablet (0.15 increments). The exposure source was a 1B sensitometer, color temperature 3000° K., equipped with a 0.6 ND (Neutral Density) filter, and HA50 (Hoya 50) filters and a filter designed to stimulate a color negative print exposure source. The elements were then processed with RA-4 chemistry through a Colenta processor. This consists of a color development (45 sec, 35° C.), bleach-fix (45 sec, 35° C.) and stabilization or water wash (90 sec, 35° C.) followed by drying (60 sec, 60° C.). The speed at 1.0 density units is listed in Table II.

| Color Developer | |
|---|---|
| Lithium salt of sulfonated polystyrene | 0.25 mL |
| Triethanolamine | 11.0 mL |

-continued

| | |
|---|---|
| N,N-diethylhydroxylamine (85% by wt.) | 6.0 mL |
| Potassium sulfite (45% by wt.) | 0.5 mL |
| Color developing agent (4-(N-ethyl-N-2-methanesulfonylaminoethyl)-2-methyl-phenylenediaminesesquisulfatemonohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2 | |

Heat sensitivity data was obtained on a sensitometer which was modified so that one half of the platten was heated to 40° C. and the other half was kept at 22° C. A 0.1 second exposure was made with a 3000° K. light source with a filter pack that included a heat absorber filter (Hoya 50), and a filter designed to stimulate a color negative print exposure source. The coatings were processed with RA-4 chemistry. The change in speed due to temperature variation (A speed) is calculated at the 1.0 density point of the D log E curve. Table II lists the heat sensitivity of cyan color paper emulsions sensitized with various mixtures of dye A-1 and Dye B-1.

TABLE II

| Example | Dye A-1 Level[a] | Dye B-1 Level[a] | Speed (logE Units) | Heat Sensitivity Δ Speed |
|---|---|---|---|---|
| 1-1 (comparison) | 1.0X | 0.0 | 1.78 | 0.11 |
| 1-2 (comparison) | 2.0X | 0.0 | 1.81 | 0.14 |
| 1-3 (comparison) | 0.0 | 2.0X | 2.14 | 0.01 |
| 1-4 | 1.0X | 2.0X | 2.14 | 0.02 |
| 1-5 | 2.0X | 2.0X | 2.07 | 0.04 |
| 1-6 | 1.5X | 1.5X | 2.10 | 0.04 |
| 1-7 | 0.5X | 0.5X | 1.95 | 0.05 |
| 1-8 | 1.0X | 1.0X | 2.08 | 0.06 |
| 1-9 | 2.0X | 1.0X | 2.00 | 0.07 |

[a]the 1X level is $3.64 \times 10^{-5}$ mol/mol Ag

Table II indicates that the heat sensitivity can be adjusted by a suitable choice of dye levels. If, for example, the magenta heat sensitivity was 04 then it would be possible to match that heat sensitivity in the cyan layer by choosing dye levels 1-5 or 1-6. The data in Table II show that, surprisingly, it is possible to adjust the heat sensitivity to a large extent while maintaining a very good speed position.

PHOTOGRAPHIC EXAMPLE 2

Emulsions were prepared in the following manner. A silver chloride emulsion (0.38 μm cubic edge length) at 40° C. was adjusted to a pH of 4.3 and a vAg of 129 mV. The emulsion was heated to 60° C. and a fine grained AgBr emulsion (0.011 mol/mol Ag) was added. The emulsion was then gold and sulfur sensitized and compound III-2 ($22.4\times 10^{-5}$ mol/mol Ag) was added followed by addition of a dye solution (see Table III, in cases were more than one dye was added, dye solutions were premixed). An anti-foggant was added (1-(3-acetamidophenyl)-5-mercaptotetrazole, $0.95\times 10^{-3}$ mol/mol Ag) and then the temperature was reduced to 40° C. and the pH was adjusted to 5.6. The emulsions were coated, exposed and processed as described above.

TABLE III

| Example | First Dye | Dye Level | Second Dye | Dye Level | Speed | Heat Sens |
|---|---|---|---|---|---|---|
| 2-1 (comparison) | B-1 | 2X | — | — | 1.84 | 0.00 |
| 2-2 (comparison) | A-1 | 2X | — | — | 1.23 | 0.17 |
| 2-3* | B-1 | 1X | A-1 | 1X | 1.70 | 0.04 |
| 2-4 (comparison) | A-3 | 2X | — | — | 0.95 | 0.17 |
| 2-5 | B-1 | 1X | A-3 | 1X | 1.34 | 0.11 |
| 2-6 (comparison) | B-2 | 2X | — | — | 1.87 | 0.05 |
| 2-7 (comparison) | A-2 | 2X | — | — | 1.16 | 0.17 |
| 2-8 | B-2 | 1X | A-2 | 1X | 1.68 | 0.10 |
| 2-9 (comparison) | B-4 | 2X | — | — | 1.37 | 0.04 |
| 2-10 | B-4 | 1X | A-1 | 1X | 1.73 | 0.07 |
| 2-11 (comparison) | A-1 | 1X | A-2 | 1X | 1.23 | 0.16 |

*average of two finishes

PHOTOGRAPHIC EXAMPLE 3

Red Sensitized Emulsions:

A high chloride silver halide emulsion was precipitated by equimolar addition of silver nitrate and sodium chloride solutions into a well-stirred reactor containing gelatin peptizer and thioether ripener. The resultant emulsion contains cubic shaped grains of 0.60 μm in edgelength size. A portion of this emulsion, at 40° C., is adjusted to a vAg of 135 mV (pH=5.6) and optimally chemically sensitized by the addition of a colloidal dispersion of gold sulfide followed by heating to 70° C. and further additions of, 1-(3-acetamidophenyl)-5-mercaptotetrazole, stilbene compound III-2, a fine-grained silver bromide emulsion (1.0 mole percent) and red sensitizing dye B-1 (see Table IV for levels). The emulsion is cooled to 40° C. and dye A-1 is added (see Table IV for levels).

A multilayer photographic element is then constructed by coating the layers as shown below, on paper stock support consisting of a mixture of hard and soft wood pulp extrusion overcoated with a titanium dioxide and zinc oxide pigmented polyethylene layer. Layers 1 to 8 can be hardened with bis (vinylsulfonyl)methyl ether at 1.8% of the total gelatin weight.

The coatings were given a Wratten 70 separation ("Red") ½" exposures and processed in RA-4 chemistry described above. The speed was measured at 0.8 density units. The results are reported in Table IV.

TABLE IV

| LAYER | COMPONENT | AMOUNT |
|---|---|---|
| 8 | ST-4 (dispersed in dibutyl phthalate) | 0.021 g/m$^2$ |
| | Absorber Dye RAD-1 | 0.010 g/m$^2$ |
| | Absorber Dye GAD-1 | 0.005 g/m$^2$ |
| | Absorber Dye BAD-1 | 0.003 g/m$^2$ |
| | Gelatin | 1.336 g/m$^2$ |
| 7 | UV-1 | 0.036 g/m$^2$ |
| | UV-2 | 0.204 g/m$^2$ |
| | ST-4 (dispersed in dibutyl phthalate) | 0.043 g/m$^2$ |
| | Gelatin | 0.653 g/m$^2$ |
| 6 | Red sensitive AgCl prepared as described above | 0.193 g Ag/m$^2$ |
| | Cyan Coupler C-1 | 0.420 g/m$^2$ |

TABLE IV-continued

| LAYER | COMPONENT | AMOUNT |
|---|---|---|
| | Absorber Dye RAD-1 | 0.010 g/m$^2$ |
| | Dibutyl phthalate | 0.250 g/m$^2$ |
| | UV-2 | 0.272 g/m$^2$ |
| | ST-4 (dispersed in dibutyl phthalate) | 0.005 g/m$^2$ |
| | p-Tolylsulfinate | 0.06 g/m$^2$ |
| | p-Tolylthiosulfinate | 0.63 g/m$^2$ |
| | Gelatin | 1.230 g/m$^2$ |
| 5 | UV-1 | 0.036 g/m$^2$ |
| | UV-2 | 0.204 g/m$^2$ |
| | ST-4 (dispersed in dibutyl phthalate) | 0.043 g/m$^2$ |
| | Gelatin | 0.653 g/m$^2$ |
| 4 | AgCl sensitized with dye GSD-7 | 0.241 g Ag/m$^2$ |
| | M-1 | 0.423 g/m$^2$ |
| | Absorber Dye GAD-1 | 0.0004 g/m$^2$ |
| | Dibutyl phthalate | 0.220 g/m$^2$ |
| | ST-2 | 0.195 g/m$^2$ |

TABLE IV-continued

| LAYER | COMPONENT | AMOUNT |
|---|---|---|
| | ST-4 (dispersed in dibutyl phthalate) | 0.037 g/m$^2$ |
| | Gelatin | 1.230 g/m$^2$ |
| 3 | ST-4 (dispersed in dibutyl phthalate) | 0.096 g/m$^2$ |
| | Gelatin | 0.749 g/m$^2$ |
| 2 | Y-1 | 0.431 g/m$^2$ |
| | Dibutyl phthalate | 0.099 g/m$^2$ |
| | Gelatin | 1.064 g/m$^2$ |
| 1 | AgCl sensitized with a dye BSD-1. | 0.270 g Ag/m$^2$ |
| | Y-1 | 0.646 g/m$^2$ |
| | Absorber Dye BAD-1 | 0.003 g/m$^2$ |
| | Dibutyl phthalate | 0.167 g/m$^2$ |
| | Gelatin | 1.064 g/m$^2$ |
| Support | $TiO_2$/ZnO pigmented polyethylene coated Paper | |

Stabilizers

UV-1

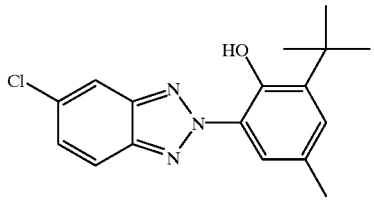

UV-2

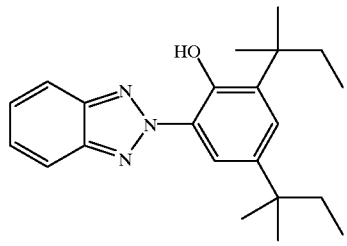

ST-2

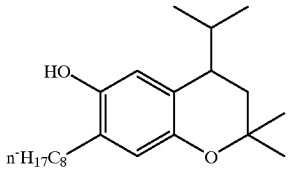

ST-4

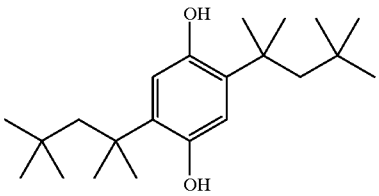

-continued
Couplers
Y-1
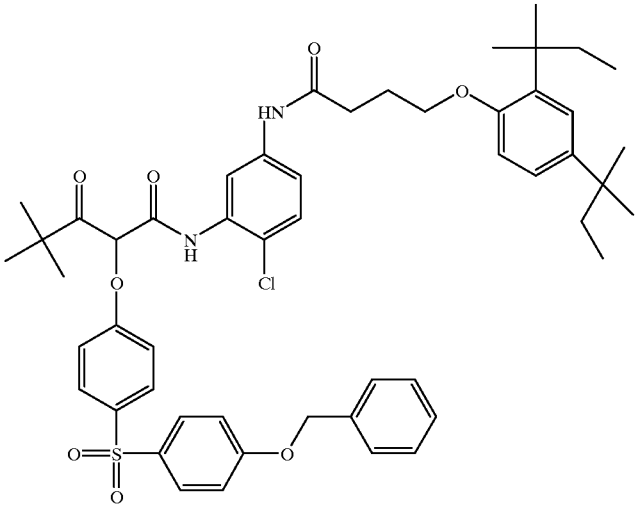
M-1
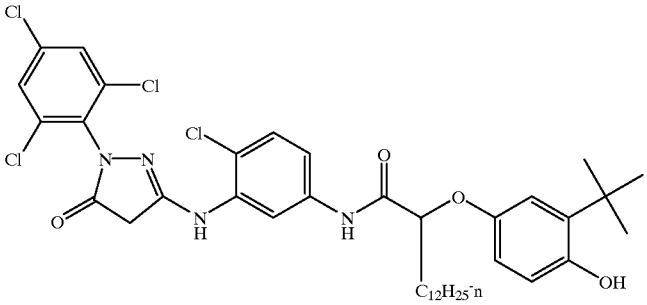
C-1
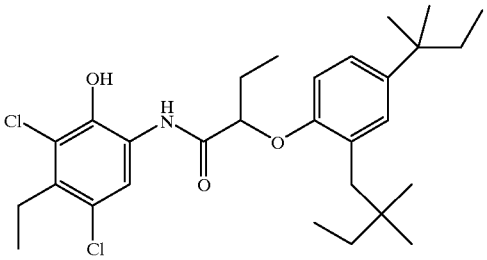
Filter Dyes
BAD-1
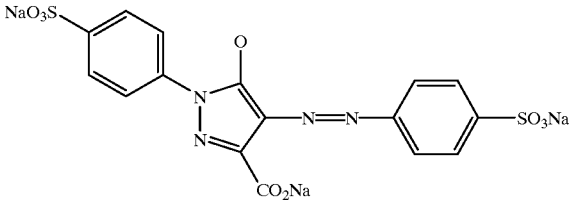
GAD-1
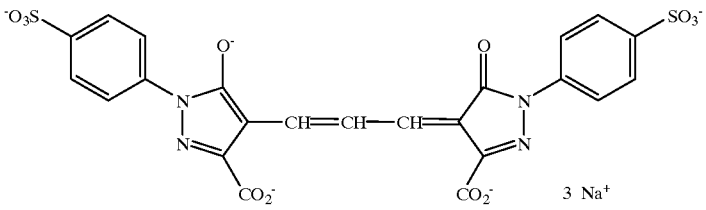

-continued

RAD-1

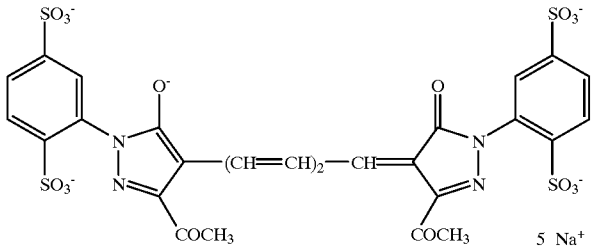

Sensitizing Dyes

BSD-1

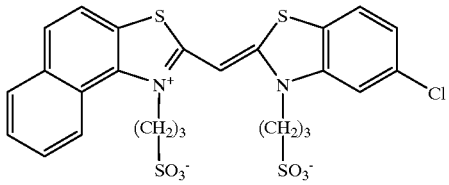

$TBA^+$ (Tetrabutylammonium)

GSD-1

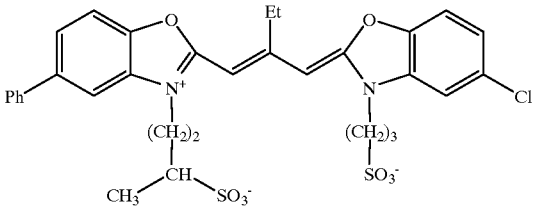

$TEAH^+$ (Triethylammonium)

TABLE IV

| Example | B-1 Dye Level* | A-1 Dye Level* | Measured Speed | Cal. Av. Spd. | Synergy | Measured Heat Sens. | Cal. Av. Heat Sens. |
|---|---|---|---|---|---|---|---|
| 3-1 | 6.5 | — | 1.605 | — | — | +.020 | — |
| 3-2 | 14.7 | — | 1.884 | — | — | +.016 | — |
| 3-4 | 33.0 | — | 2.054 | — | — | −.007 | — |
| 3-5 | — | 7.0 | 1.585 | — | — | +.065 | — |
| 3-6 | — | 11.5 | 1.750 | — | — | +.073 | — |
| 3-7 | — | 23.0 | 1.907 | — | — | +.081 | — |
| 3-8 | 14.7 | 11.5 | 1.956 | 1.817 | +.139 | +.033 | +.045 |
| 3-9 | 14.7 | 23.0 | 1.999 | 1.896 | +.103 | +.044 | +.049 |
| 3-10 | 33.0 | 23.0 | 2.100 | 1.981 | +.119 | +.018 | +.037 |

*mg/AgM

As can be see from Table IV, in addition to heat sensitivity control, a speed synergy (higher speed than the expected average speed) is obtained by using a mixture of the two dyes.

PHOTOGRAPHIC EXAMPLE 4

A series of emulsions were sensitized as in Example 3 except the finish pH was adjusted to 4.5, the VAg to 128 mV, and the heat treatment was at 55° C. instead of 70° C. The emulsions were coated, processed, and exposed as described in Example 3. Results are reported in Table V.

TABLE V

| Example | B-1 Dye Level* | A-1 Dye Level* | Measured Speed | Cal. Av. Spd. | Synergy | Measured Heat Sens. | Cal. Av. Heat Sens. |
|---|---|---|---|---|---|---|---|
| 4-1 | 14.7 | 0 | 1.707 | — | — | −.045 | — |
| 4-2 | 22.0 | 0 | 1.800 | — | — | −.049 | — |
| 4-3 | 33.0 | 0 | 1.899 | — | — | −.051 | — |
| 4-4 | 0 | 7.0 | 1.486 | — | — | +.023 | — |
| 4-5 | 0 | 11.5 | 1.625 | — | — | +.022 | — |
| 4-6 | 0 | 23.0 | 1.795 | — | — | +.029 | — |
| 4-7 | 14.7 | 11.5 | 1.956 | 1.666 | 0.290 | −.033 | −.023 |
| 4-8 | 14.7 | 23.0 | 1.800 | 1.751 | 0.049 | −.019 | −.016 |
| 4-9 | 33 | 23.0 | 2.019 | 1.847 | 0.172 | −.044 | −.022 |

*mg/AgM

It can be seen from the data in Table V that heat sensitivity can be controlled while maintaining a good speed position by using the dye combination.

PHOTOGRAPHIC EXAMPLE 5

A 0.4 $\mu$m edge length cubic AgCl grain was sensitized as described in Example 3 using a finish pH 5.6 and VAg at 105 mV. The heat treatment was at 65° C. and the dyes were added as indicated in Table VI. Where dyes were added in the same location, the dyes were remixed before adding in the sensitization. The bromide source was either a fine-grained "Lippmann" silver bromide emulsion (LBr) or KBr. The sensitized emulsions were coated, exposed, and processed as described in Example 3. Results are reported in Table VI.

TABLE VI

| Exp | B-1 Amt | B-1 Location | A-1 Amt | A-1 Location* | Br Type | Measured Speed | Average Speed | Synergy | Heat Sens |
|---|---|---|---|---|---|---|---|---|---|
| 5-1 | 22 | Before Heat | — | — | LBr | 1.659 | — | — | +.036 |
| 5-2 | — | — | 20 | Before Heat | LBr | 1.430 | — | — | +.091 |
| 5-3 | 22 | Before Heat | 20 | Before Heat | LBr | 1.683 | 1.545 | +.138 | +.074 |
| 5-4 | 22 | Heat | — | — | LBr | 1.746 | — | — | −.004 |
| 5-5 | — | — | 20 | Heat | LBr | 1.517 | — | — | +.074 |
| 5-5 | 22 | Heat | 20 | Heat | LBr | 1.781 | 1.632 | +.149 | +.041 |
| 5-6 | 22 | After Heat | — | — | LBr | 1.549 | — | — | +.024 |
| 5-7 | — | — | 20 | After Heat | LBr | 1.444 | — | — | +.090 |
| 5-8 | 22 | After Heat | 20 | After Heat | LBr | 1.565 | 1.497 | +.068 | +.078 |
| 5-9 | 22 | Before Heat | — | — | KBr | 1.769 | | | +.021 |
| 5-10 | | — | 20 | Before Heat | KBr | 1.616 | — | — | +.069 |
| 5-11 | 22 | Before Heat | 20 | Before Heat | KBr | 1.870 | 1.693 | +.177 | +.066 |
| 5-12 | 22 | Heat | — | — | KBr | 1.788 | — | — | +.007 |
| 5-13 | | — | 20 | Heat | KBr | 1.619 | — | — | +.067 |
| 5-14 | 22 | Heat | 20 | Heat | KBr | 1.824 | 1.704 | +.120 | +.050 |
| 5-15 | 22 | After Heat | — | — | KBr | 1.487 | — | — | +.030 |
| 5-16 | | — | 20 | After Heat | KBr | 1.457 | — | — | +.090 |
| 5-17 | 22 | After Heat | 20 | After Heat | KBr | 1.578 | 1.472 | +.106 | +.073 |

*Heat means added during the heat treatment.

Many dye locations were investigated and the speed synergy was seen in all locations as illustrated by Table VI which included examples of dye locations before, during and after the heat treatment. The synergy was also observed with different bromide sources.

The results in Table II-VI indicate that dyes of Class A and Class B when used in combination and with a compound of Formula III afford excellent red sensitization. By adjusting the dye ratio it is possible to adjust the heat sensitivity of the red layer.

The invention has been described in detail with particular reference to preferred embodiments, but it will be understood that variations and modifications can be effected within the spirit and scope of the invention.

What is claimed is:

1. A silver halide photographic material comprising a red sensitive silver halide emulsion layer wherein the silver halide content of the silver halide emulsion layer is at least 90 mole percent silver chloride, and which emulsion comprises Dye A, and Dye B:

wherein:

Dye A is of structure I or II (I)

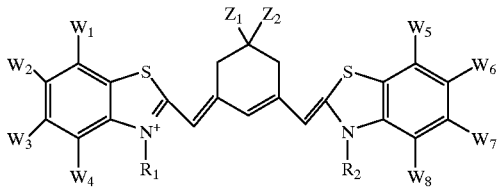

X (II)

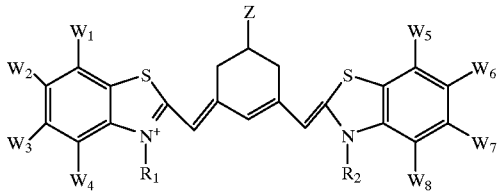

X where, $R_1$ and $R_2$ each independently represent an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group;

$W_1$–$W_8$ each independently represent a hydrogen atom, a halogen atom, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, or aryloxy group, and $W_1$ and $W_2$; $W_2$ and $W_3$; $W_3$ and $W_4$; $W_5$ and $W_6$; $W_6$ and $W_7$; $W_7$ and $W_8$ can bond to each other via their carbon atoms to form a condensed ring; and wherein:

in structure I substituents $W_1$–$W_8$ are chosen such that J is $\geqq 0.0$, where J is defined as the sum of the Hammett $\sigma_p$ values of $W_1$–$W_8$, and in structure II substituents $W_1$–$W_8$ are chosen such that J is $\geqq 0.24$; and Dye B is of formula I or II:

(I)

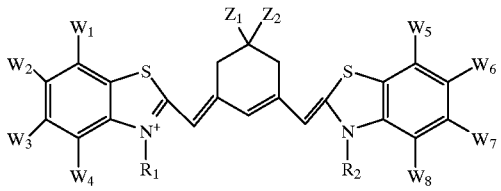

X

-continued (II)

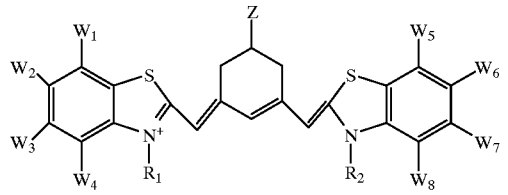

X where, $R_1$ and $R_2$ each independently represent an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ are each independently a 1–8 carbon alkyl group;

$W_1$–$W_8$ each independently represent a hydrogen atom, a halogen atom, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, or aryloxy group, and $W_1$ and $W_2$; $W_2$ and $W_3$; $W_3$ and $W_4$; $W_5$ and $W_6$; $W_6$ and $W_7$; $W_7$ and $W_8$ can bond to each other via their carbon atoms to form a condensed ring; and wherein:

in structure I substituents $W_1$–$W_8$ are chosen such that J is <0.14, and in structure II substituents $W_1$–$W_8$ are chosen such that J is $\leqq 0.10$.

2. A silver halide photographic material according to claim 1 wherein Z is a hydrogen atom or a 1 to 8 carbon atom substituted or unsubstituted alkyl group, and $W_1$–$W_8$ each independently represents a hydrogen atom, a 1 to 8 substituted or unsubstituted alkyl group, or a substituted or unsubstituted phenyl group.

3. A silver halide photographic material according to claim 1 wherein each of $W_1$–$W_8$ represents a methyl, hydrogen or phenyl.

4. A silver halide photographic material according to claim 1, wherein $W_1$–$W_8$ can independently represent hydrogen or methyl.

5. A silver halide photographic material according to claim 1, wherein both of $R_1$ and $R_2$ are alkyl of 1–8 carbon atoms.

6. A silver halide photographic material according to claim 1, wherein Z represents a hydrogen or a methyl group.

7. A silver halide photographic material according to claim 1, wherein $Z_1$ and $Z_2$ are methyl groups.

8. A silver halide photographic material according to claim 1, wherein Z represents a hydrogen.

9. A photographic element according to claim 1 wherein the silver halide emulsion further comprises a compound of formula (III):

(III)

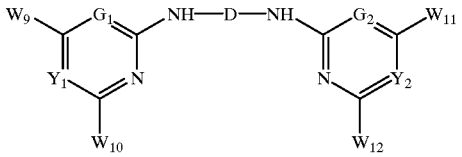

wherein:

D is a divalent aromatic moiety;

$W_9$–$W_{12}$ each independently represents a hydroxy, a halogen atom, an amino, alkylamino, arylamino, cycloalkylamino, a heterocyclic, heterocyclicamino, arylalkylamino, alkoxy, aryloxy, alkylthio, heterocyclicthio, mercapto, alkylthio, arylthio or aryl group, any of which may be substituted or unsubstituted, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

10. A silver halide photographic material according to claim 9 wherein $W_9$–$W_{12}$ each independently represent an aryloxy or arylamino, any of which may be substituted or unsubstituted.

11. A silver halide photographic material according to claim 1, wherein at least Dye A is of Structure I.

12. A silver halide photographic material according to claim 1, wherein at least Dye B is of Structure I.

13. A silver halide photographic material of claim 1, wherein the material comprises at least two dyes defined as Dye A in claim 1.

14. A silver halide photographic material of claim 1, wherein the material comprises at least two dyes defined as Dye B in claim 1.

15. A silver halide photographic material comprising a red sensitive silver halide emulsion layer wherein the silver halide content of the silver halide emulsion layer is at least 90 mole percent silver chloride, and which emulsion contains a dye of formula (Ia) and a dye of formula (IIa):

(Ia)

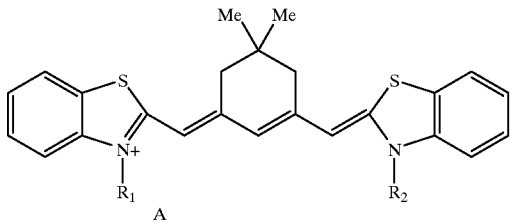

A

-continued (IIa)

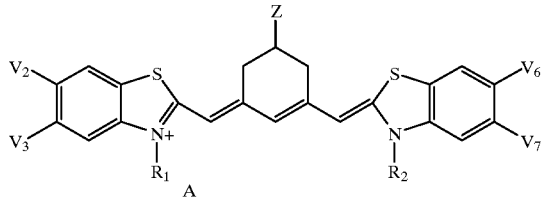

A where:

$R_1$ and $R_2$ each independently represent an alkyl group or a substituted alkyl group;

$V_2$–$V_7$ are independently H or a 1 to 8 carbon alkyl;

Z is a hydrogen or methyl;

A is a counterion if needed to balance the charge.

16. A photographic material according to claim 15 wherein the emulsion further comprises a compound of formula (III):

(III)

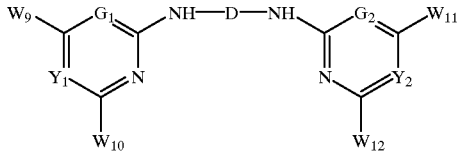

wherein:

D is a divalent aromatic moiety

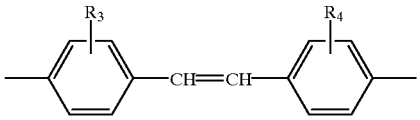

in which $R_3$ and $R_4$ are independently an acid or acid salt group, or an acid or acid salt substituted alkyl;

$W_9$–$W_{12}$ each independently represents a hydrogen atom, a halogen atom, an amino, alkylamino, arylamino, cycloalkylamino, heterocyclicamino, arylalkylamino, alkoxy, aryloxy, alkylthio, heterocyclicthio, mercapto, alkylthio, arylthio or aryl group, any of which may be substituted or unsubstituted, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

17. A silver halide photographic material according to claim 16 wherein the silver halide is at least about 95 percent silver chloride.

18. A silver halide photographic material according to claim 16 additionally comprising a heterocyclic mercapto anti-foggant compound.

* * * * *

UNITED STATES PATENT AND TRADEMARK OFFICE

CERTIFICATE OF CORRECTION

PATENT NO. : 6,120,982
DATED : September 19, 2000
INVENTOR(S) : Richard Lee Parton et al.

It is certified that error appears in the above-identified patent and that said Letters Patent is hereby corrected as shown below:

Title page,
Column 1, after [22], insert

-- Related U.S. Application Data

[60] Provisional Application Serial No. 60/004,513; filed Sept. 29, 1995. --

Column 1,
After the title, insert the following:

-- CROSS REFERENCE TO RELATED APPLICATION
Reference is made to and priority claimed from U.S. Provisional Application Serial No. US 60/004,513, filed September 29, 1995, entitled RED SENSITIZING DYE COMBINATIONS FOR HIGH CHLORIDE EMULSIONS. --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*